US010716382B2

(12) United States Patent
Bickford

(10) Patent No.: US 10,716,382 B2
(45) Date of Patent: Jul. 21, 2020

(54) HAIR DYE PEN

(71) Applicant: L'Oreal, Paris (FR)

(72) Inventor: William Bickford, Clark, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 15/967,105

(22) Filed: Apr. 30, 2018

(65) Prior Publication Data

US 2019/0328103 A1 Oct. 31, 2019

(51) Int. Cl.
*A45D 19/00* (2006.01)
*A45D 19/02* (2006.01)

(52) U.S. Cl.
CPC ..... *A45D 19/0008* (2013.01); *A45D 19/02* (2013.01); *A45D 2200/1045* (2013.01)

(58) Field of Classification Search
CPC ..... A45D 19/0008; A45D 19/02; B43K 8/022
USPC ..... 401/193
See application file for complete search history.

(56) References Cited

U.S. PATENT DOCUMENTS 3,205,863 A 9/1965 Rhoades
6,921,223 B2 7/2005 Marschand
6,964,534 B2 * 11/2005 Brand ..... B43K 8/022 401/107
7,000,619 B2 2/2006 Winckels et al.
7,156,885 B2 * 1/2007 Kennedy ..... A45D 19/02 132/208
7,500,487 B2 3/2009 Kobayashi et al.
7,775,734 B2 8/2010 Dylkiewicz et al.
8,221,012 B2 7/2012 Rennecker
9,271,554 B2 3/2016 Nakashima
2010/0003790 A1 1/2010 Kronmueller et al.
2010/0037910 A1 2/2010 Müller-Grünov et al.
2011/0243640 A1 * 10/2011 Bogert ..... B43K 23/001 401/193
2014/0069453 A1 * 3/2014 Prinz ..... A45D 2/40 132/208
2015/0027484 A1 * 1/2015 Narbut ..... A45D 19/0008 132/208
2018/0042353 A1 * 2/2018 Dowd ..... A45D 19/0008
2018/0056706 A1 * 3/2018 Ballot ..... B43K 24/08
2018/0332944 A1 * 11/2018 Elliott ..... A45D 19/02

FOREIGN PATENT DOCUMENTS

FR 3029078 A1 6/2016

* cited by examiner

*Primary Examiner* — David P Angwin
*Assistant Examiner* — Bradley S Oliver
(74) *Attorney, Agent, or Firm* — Christensen O'Connor Johnson Kindness PLLC

(57) ABSTRACT

A hair dye device includes a barrel, wherein the barrel includes a hollow center and a hook extending from one end of the barrel and an absorbent material impregnated with hair dye, wherein the absorbent material is configured to extend beyond the one end of the barrel, wherein a tip of the absorbent material moves toward the hook to provide a loop to capture hair within the loop.

19 Claims, 6 Drawing Sheets

HAIR DYE PEN

SUMMARY

In an embodiment, a hair dye device, comprises a barrel, wherein the barrel includes a hollow center and a hook extending from one end of the barrel; an absorbent material impregnated with hair dye, wherein the absorbent material is configured to extend beyond the one end of the barrel, wherein a tip of the absorbent material moves toward the hook to provide a loop to capture hair within the loop.

In an embodiment, the absorbent material is configured to retract within the hollow center.

In an embodiment, the hook is an extension of the barrel.

In an embodiment, the hook extends from the one end of the barrel and curves from one side of the barrel toward the opposite side and crosses over the hollow center.

In an embodiment, the hook extends from the one end of the barrel and curves from one side of the barrel toward the opposite side and crosses over the barrel center, and the absorbent material extends from the hollow center toward the hook.

In an embodiment, the hollow center extends in the axial direction.

In an embodiment, the hook and absorbent material form the loop with a side of the absorbent material impregnated with dye facing the interior of the loop.

In an embodiment, the hook and absorbent material form a fully closed loop when the absorbent material is touching the hook.

In an embodiment, the hook and absorbent material form a partly open loop when the absorbent material is not touching the hook.

In an embodiment, the barrel is on the device exterior, and the absorbent material is on the interior of the barrel.

In an embodiment, the absorbent material includes fibers, bristles, paper, pulp, animal hairs, felt, or a combination thereof.

In an embodiment, the hair dye device further comprises a reservoir connected to the absorbent material.

In an embodiment, a method of making a hair dye device, comprises providing a barrel, wherein the barrel includes a hollow center and a hook extending from one end of the barrel; providing an absorbent material; and assembling the absorbent material in the hollow center of the barrel, wherein the absorbent material is configured to extend beyond the one end of the barrel, wherein a tip of the absorbent material moves toward the hook to provide a loop to capture hair within the loop.

In an embodiment, the method further comprises impregnating the absorbent material with a hair dye.

In an embodiment, the method further comprises replacing a depleted absorbent material with a freshly impregnated absorbent material.

In an embodiment, the method further comprises filling a hair dye reservoir in the barrel.

In an embodiment, a method of dying hair, comprises providing an absorbent material impregnated with hair dye within a barrel having a hollow center and a hook extending from one end of the barrel, wherein the absorbent material is configured to extend beyond the one end of the barrel; and moving the absorbent material toward the hook to provide a loop to capture hair within the loop.

In an embodiment, the method further comprises moving the barrel with the hair captured in the loop along a length of the hair.

In an embodiment, the method further comprises the hair is captured in the loop and the absorbent material impregnated with hair dye is facing toward the interior of the loop.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Hair dye is conventionally applied in broad swaths. Usually the entire head of hair is dyed all at once. Sometimes a brush can be used to narrow the application to a particular section of hair, such as to the roots. There is a need for a hair dye applicator device that allows the user to specifically target one to several strands or small sections of hair at one time for dyeing.

Figure 1:
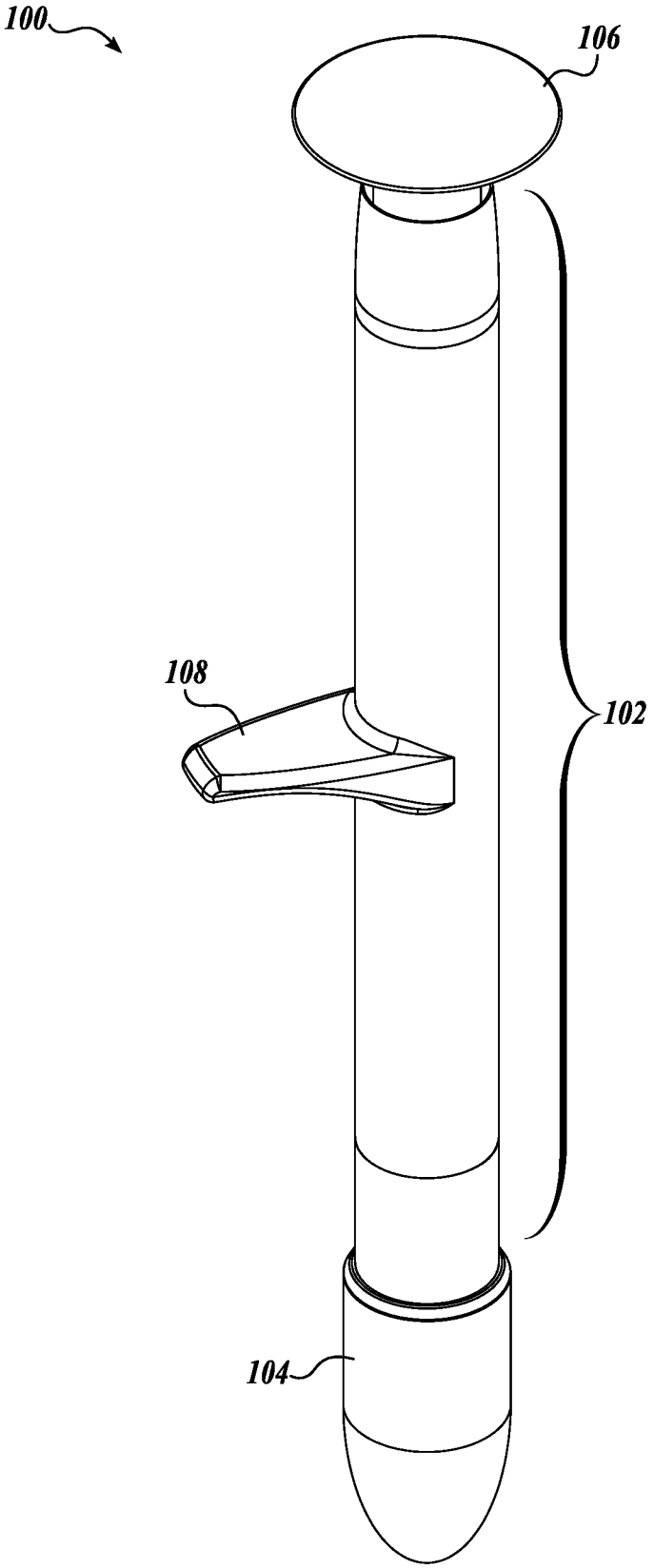
FIG. 1 is a diagrammatical illustration of an embodiment of a hair dye device.

FIGS. 1-5 show a hair dye device 100 configured for dyeing one or more strands of hair at a time. Referring to FIG. 1, the visible components on the exterior of the hair dye device 100 include a barrel 102, a removable cap 104, and a plunger 106. In one embodiment, the hair dye device 100 includes a finger grip 108 attached to and projecting radially outward from the barrel 102. The finger grip 108 allows the person using the hair dye device 100 to adopt several configurations for holding the hair dye device 100. The barrel 102 is generally encompasses the elongated body of the hair dye device 100. The barrel 102 may include several separable parts that as a whole make up the entire barrel 102. Barrel parts are screwed or glued or otherwise attached to each to each other. The barrel 102 is designed to contain on the inside a hair dye, a stylus for applying the hair dye, and in one embodiment, a retracting mechanism 122 for extending the stylus out of the barrel when dyeing hair. To this end, the barrel 102 has an open end through which the stylus extends. Depending on the particular retracting mechanism 122 on the inside of the barrel 102, the barrel 102 can assume various shapes or configurations. The cap 104 is to cover the open end of the barrel to prevent the hair dye composition inside of the hair dye device 100 from drying or oxidation.

Figure 2:
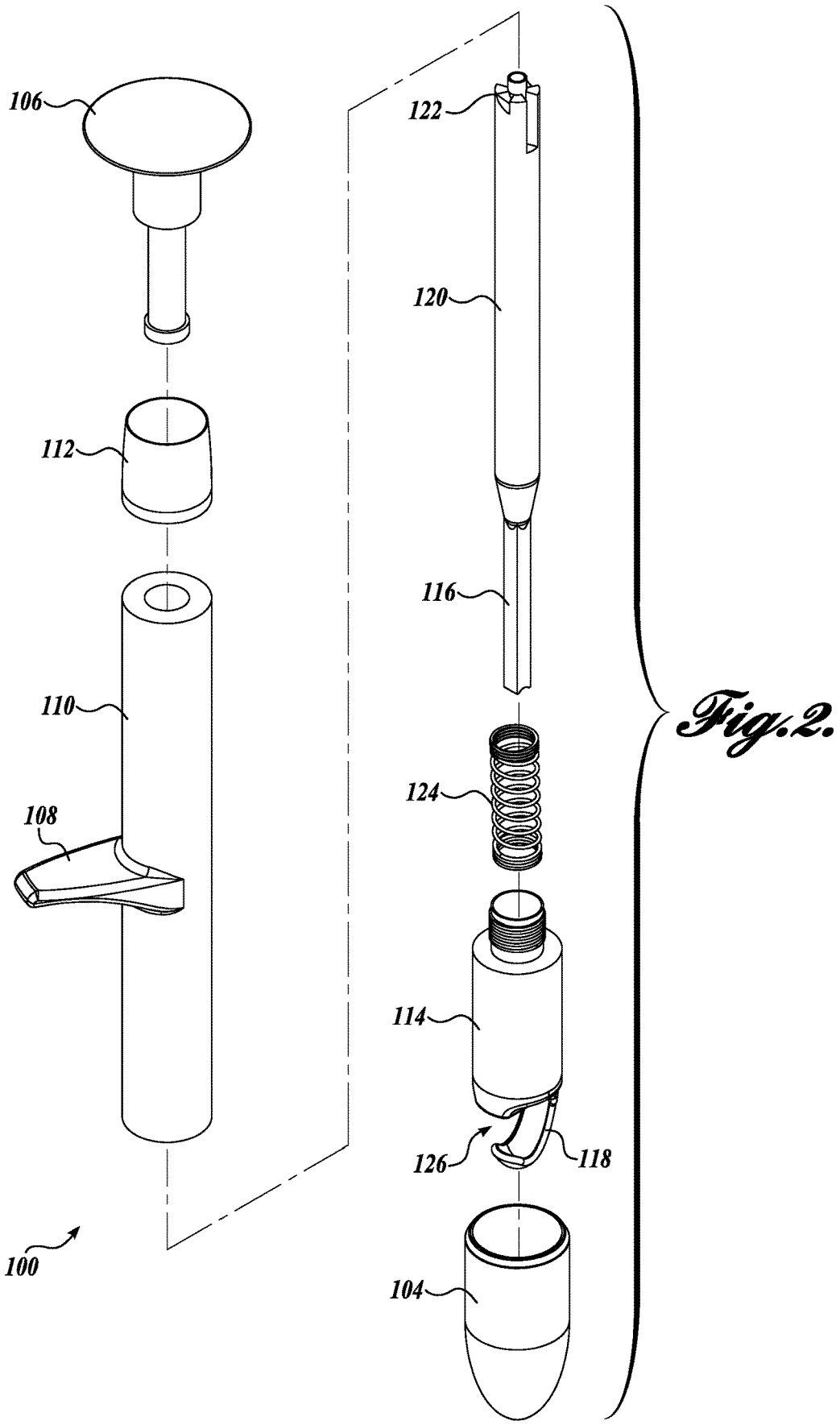
FIG. 2 is a diagrammatical exploded view illustration of the hair dye device of FIG. 1.
Figure 5:
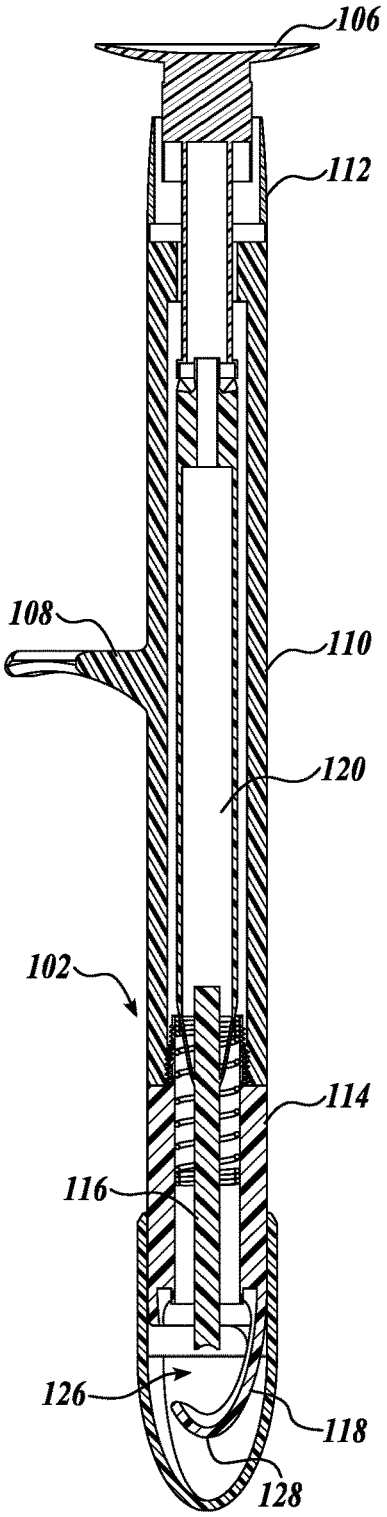
FIG. 5 is a diagrammatical cross sectional view illustration of the hair dye device of FIG. 1.

Referring to FIG. 2, the internal as well as the external components of the hair dye device 100 are shown. In an embodiment, the barrel 102 is not a unitary piece and can be assembled from two or more parts. In one embodiment, the barrel 102 includes an upper collar 112, a main body 110, and a lower nib 114. In an embodiment, the collar 112, main body 110, and nib 114 are physically separable parts, and the collar 112 and nib 114 are screwed or otherwise joined to respective ends of the main body 110 to form the entire barrel 102. In an embodiment, the collar 112, main body 110 and nib 114 are integral or monolithic with respect to each other. In this disclosure, the barrel 102 can be referenced in its entirety, or the sections of the barrel can be referenced specifically. Other embodiments of the barrel 102 can have fewer or more sections. Embodiments of the barrel 102, collar 112, main body 110, and nib 114 have a hollow center running axially as seen in FIG. 5 to accommodate the interior parts.

Referring to FIG. 2, the barrel 102 has a hook 118, specifically at the nib 114, extending axially from the barrel 102. The hook 118 is more slender than the diameter of the barrel 102. The hook 118 starts by extending axially or at an incline from the one end (i.e., from the nib 114) of the barrel 102 and continues extending radially while curving from one side of the barrel 102 toward the directly opposite side crossing over the hollow center of the barrel 102 as seen in FIG. 5. Continuing to refer to FIG. 5, in an embodiment, the hook 118 reaches an apex 128 at the maximum extension in the axial direction and then begins to curve back toward the opposite axial direction from which it started while also continuing to extend radially. In an embodiment, the apex 128 of the hook 118 is in line with the radial center of the barrel 102.

In an embodiment, the hook 118 describes an arc joined at one end to the barrel 102 and terminating at an unconnected end, thereby leaving a gap 126 between the unconnected hook end and the end of the barrel 102. In an embodiment, unconnected end is the end of the hook 118 that is not joined to the barrel 102. In an embodiment, the hook 118 circumscribes about 90 degrees of arc from the start of the hook 118 where it joins the barrel 102 to the unconnected end. In an embodiment, the hook 118 circumscribes less than 90 degrees of arc from the start of the hook 118 where it joins the barrel 102 to the unconnected end. In an embodiment, the hook 118 circumscribes an arc in the range of about 45 degrees to about 90 degrees from the start of the hook 118 where it joins the barrel 102 to the unconnected end. In an embodiment, the hook 118 circumscribes greater than 90 degrees of arc from the start of the hook 118 where it joins the barrel 102 to the unconnected end. In an embodiment, the hook 118 circumscribes an arc in the range of about 90 degrees to less than 180 degrees from the start of the hook 118 where it joins the barrel 102 to the unconnected end.

Referring to FIG. 2, the hair dye device 100 includes a stylus 116 made from an absorbent material 116 which is impregnated with hair dye. In an embodiment, the absorbent material 116 is elongated, has a rectangular cross section, and a tip that is concave at the distal side. The absorbent material 116 is normally housed within the barrel 102 to preserve the hair dye from drying. In an embodiment, the absorbent material 116 is configured to extend forward from within the hollow center of the barrel 102 beyond the one end (i.e., from the nib 114) of the barrel 102 via a retracting mechanism 122. In an embodiment, when the absorbent material 116 is caused to be extended, the absorbent material 116 is in line with the apex 128 of the hook 118. In one embodiment, the side of the hook 118 facing the tip of the absorbent material 116 is cupped so that the tip of the absorbent material 116 comes to rest in a pocket. This can reinforce and provide support to the absorbent material 116 to provide resistance against bending or breaking.

For practicing the embodiments of this disclosure, in some embodiments, the retracting mechanism 122 that is configured to extend and retract the absorbent material 116 to and away from the hook 118 is chosen from among the retracting mechanisms that apply to retracting pens, markers, and the like. Representative retracting mechanisms 122 are disclosed in, for example, U.S. Pat. Nos. 8,221,012; 7,775,734; 6,921,223; and 3,205,863, all of which are incorporated herein by reference for teaching a retractable mechanism.

In an embodiment, the absorbent material 116 is attached to a hair dye reservoir 120 or container. The absorbent material 116 is continually replenished with hair dye by wicking hair dye from the reservoir 120 to the tip of the absorbent material 116. In an embodiment, the reservoir 120 is refillable. In an embodiment, the reservoir 120 with absorbent material 116 is disposable and is replaced with a newly charged reservoir and absorbent material. Other configurations for replenishing the absorbent material 116 are also possible. A number of absorbent materials are appropriate for the absorbent material 116. In an embodiment, the absorbent material 116 is made from natural or synthetic fibers, bristles, paper, pulp, animal hairs, felt, or a combination thereof.

The absorbent material 116 is configured to move axially from a retracted position from within the barrel 102 to an extended position which brings the absorbent material 116 in proximity to the hook 118. In an embodiment, when the absorbent material 116 is extended, the hook 118 and absorbent material 116 form a loop with a side of the absorbent material 116 impregnated with dye facing the interior of the loop. The loop is used for capturing and encircling one or more strands of hair. In an embodiment, the hair is captured within the loop. In another embodiment, the hair is pinched between the tip and the hook. In yet another embodiment, the hair is captured within the loop and the hair is pinched between the tip and the hook. In an embodiment, when the absorbent material 116 is extended, the hook 118 and absorbent material 116 form a fully closed loop when the absorbent material extends far enough to contact the hook 118. In an embodiment, when the absorbent material 116 is extended, the hook 118 and absorbent material 116 form a partly open loop such that the absorbent material is not touching the hook 118.

The retracting mechanism 122 may be implemented in several ways. However, in an embodiment, the hair dye device need not have a retracting mechanism 122. In the latter case, the absorbent material may be continually in the extended position to form a loop with the hook 118, and the one or more strands of hair to be dyed are inserted within the loop by yielding of the absorbent material 116. For example, the absorbent material is biased against the hook by a spring, which will yield when the strands of hair are pushed against the tip of the absorbent material to admit the strands of hair within the loop.

Figure 3:
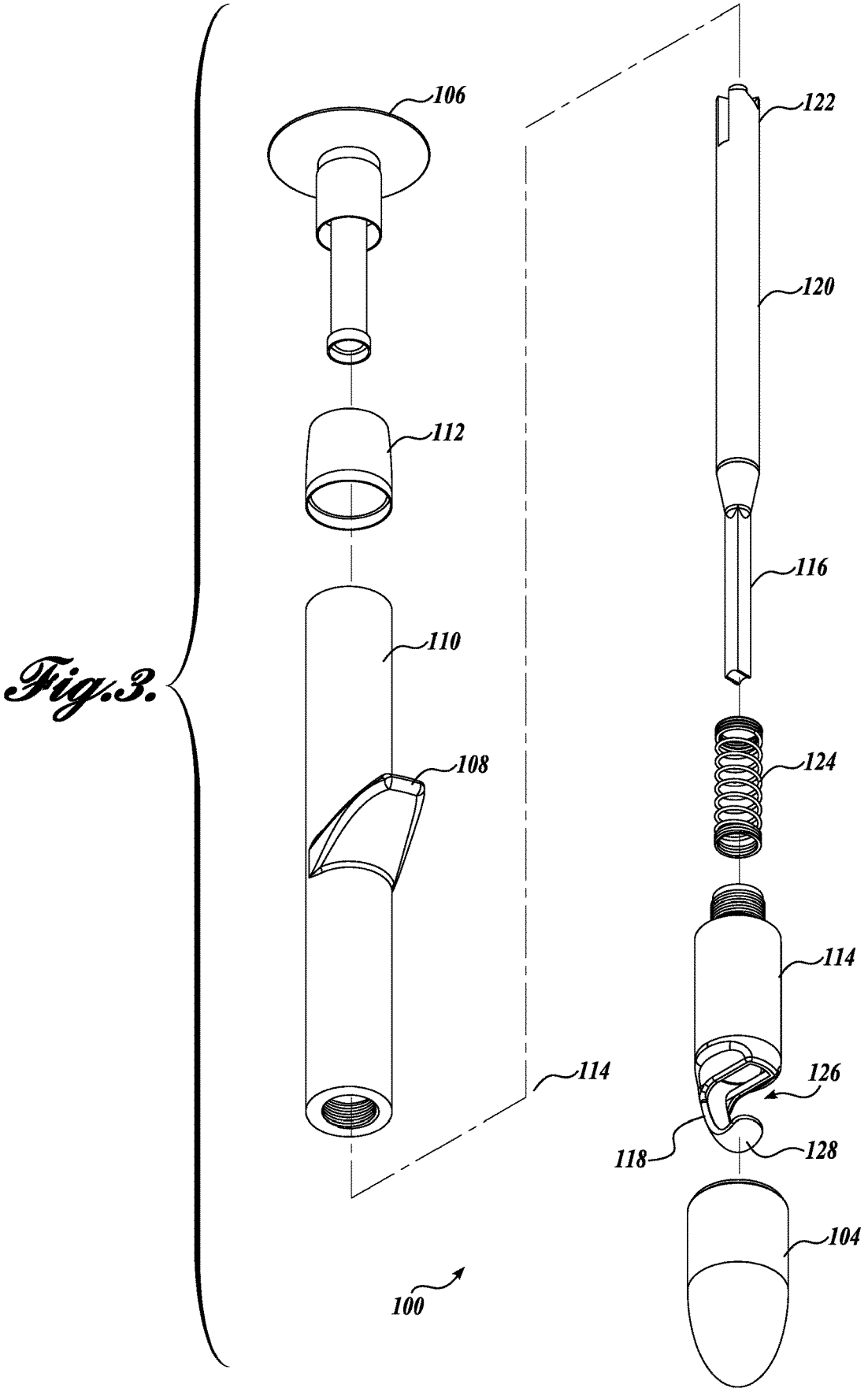
FIG. 3 is a diagrammatical exploded view illustration of the hair dye device of FIG. 1.
Figure 4:
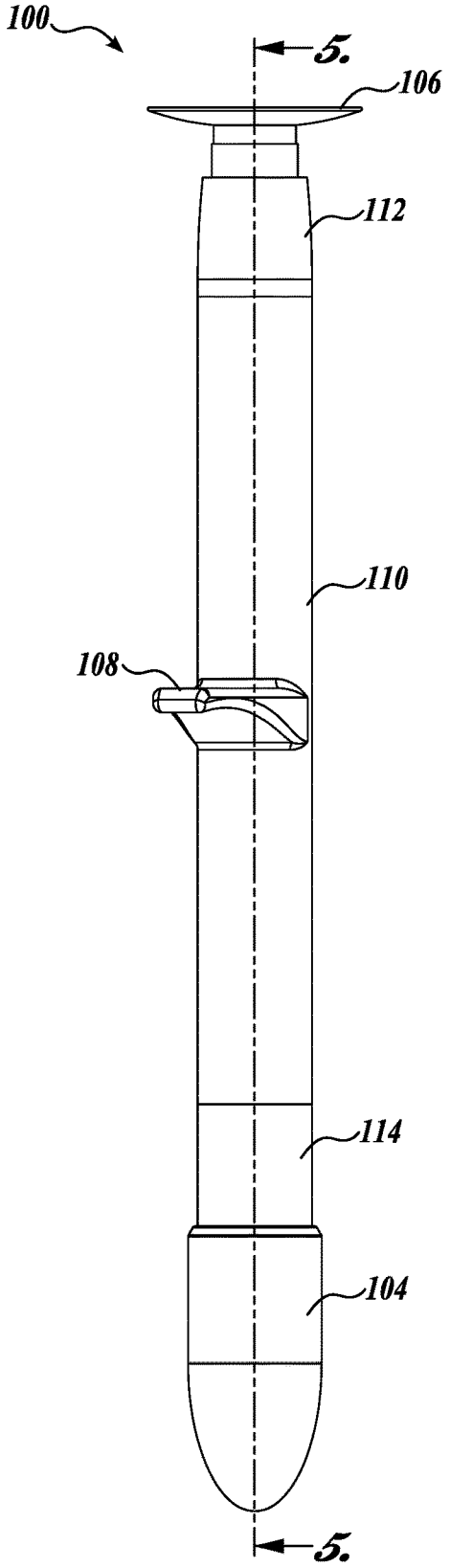
FIG. 4 is a diagrammatical illustration of the hair dye device of FIG. 1.

Referring to FIGS. 2 and 3, the dye hair reservoir 120 is hollow on the inside and can be pre-filled with hair dye of one color. While one end of the reservoir 120 receives the absorbent material 116, the opposite end of the reservoir 120 is configured into the retracting mechanism 122, and a complimentary part of the retracting mechanism 122 is provided on the end of the plunger 106.

In an embodiment, the retracting mechanism 122 includes a cam on the upper end of the reservoir 120. The cam operates on the principal similar to the design of U.S. Pat. No. 3,205,863. A brief description of the principal of operation of one embodiment of the retracting mechanism 122 follows.

The cam is a cylindrical body with long and short notches alternating on the periphery. In an embodiment, two short notches and two long notches are provided forming crenulations between adjacent notches. The crenulations between adjacent notches as well as the bottoms of the notches are wedged-shaped. The notches cooperate with stop members (not shown) that alternately engage with the short and long notches. The stop members are provided in corresponding structure on the end of the plunger 106. When a stop member is engaged in a short notch, giving a longer effective length to the reservoir 120 and absorbent material 116, the reservoir 120 and absorbent material 116 would be extended beyond the open end of the barrel 102. When the stop member is engaged in the long notch, reducing the effective length, the reservoir 120 and absorbent material 116 would retract inside the barrel 102 with assistance from the spring 124. The extension and retraction are brought about by depressing the plunger 106 with a thumb or finger. Each depression of the plunger 106 brings about the extension or retraction action. The plunger 106 is continually being biased upward by the spring 124 acting on the reservoir 120 as seen in FIG. 5. When the reservoir 120 and absorbent material 116 are retracted, and the pair of stop members (not shown) are in the long notches, then depressing the plunger 106 pushes the reservoir 120 down, the pair of stop members (not shown) ride up in the long notches until the stop members clear the tops of the long notches causing the reservoir 120 to rotate because of the wedges on the tops of the crenulations and the bottoms of the stop members which also have wedges. The stop members stop rotation by hitting against a high side of a crenulation which brings the stop members into alignment with the short notches. Then, releasing the plunger 106 up, the reservoir 120 is prevented from retracting further by the stop members engaged in the short notches keeping the reservoir 106 and the absorbent material 116 at the extended position until the next time the plunger is depressed.

For practicing the embodiments of this disclosure, in some embodiments, the retracting mechanism 122 that is configured to extend and retract the absorbent material 116 to and away from the hook 118 is chosen from among the retracting mechanisms that apply to retracting pens, markers, and the like. Representative retracting mechanisms 122 are disclosed in, for example, U.S. Pat. Nos. 8,221,012; 7,775,734; 6,921,223; and 3,205,863, all of which are incorporated herein by reference for teaching a retractable mechanism.

Hair dye compositions include any composition that can add or change the color of hair. The term is to be construed to include compositions that change or reduce the color of the hair, such as oxidizing agents, peroxide, bleaches, and the like. Suitable hair dye composition are based on amines, including but not limited to derivatives of nitrodiphenylamine (U.S. Pat. No. 3,950,127), azo derivatives of pyridine N-oxide (U.S. Pat. No. 3,955,918), p-phenylenediamine (U.S. Pat. No. 3,970,423), diamino-benzoquinones (U.S. Pat. No. 4,023,926), indoaniline (U.S. Pat. No. 4,045,170), and the like.

Figure 6:
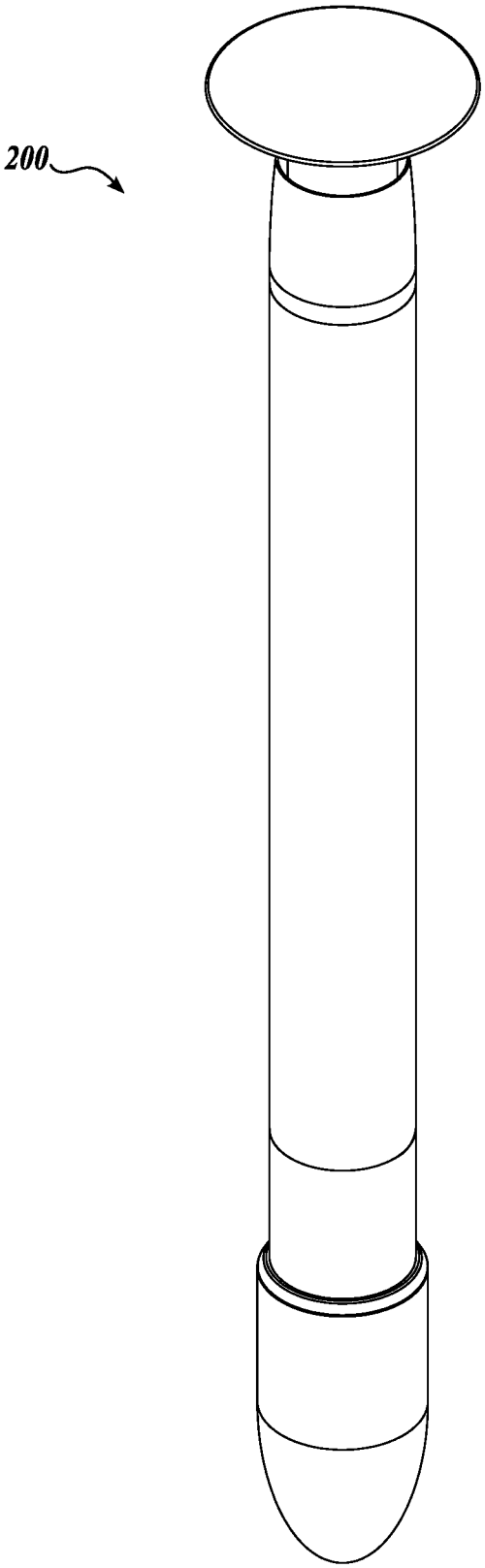
FIG. 6 is a diagrammatical illustration of an embodiment of a hair dye device.

Referring to FIG. 6, another embodiment of a hair dye device 200 is shown. The hair dye device of FIG. 6 is in all respects similar to the hair dye device of FIGS. 1-5, except that hair dye device 200 does not include the finger grip 108 of hair dye device 100. In all other respects, hair dye device 200 is similar to hair dye device 100.

Further disclosed is a method of making a hair dye device 100 or 200. The method includes providing a barrel 102, wherein the barrel includes a hollow center and a hook 118 extending from one end of the barrel. The method includes providing an absorbent material 116. The method includes assembling the absorbent material in the hollow center of the barrel, wherein the absorbent material is configured to extend beyond the one end of the barrel, wherein a tip of the absorbent material moves toward the hook to provide a loop to capture hair within the loop.

In an embodiment, the method further includes impregnating the absorbent material with a hair dye before or after assembling the absorbent material in the barrel.

In an embodiment, the method further includes replacing a depleted absorbent material with a freshly impregnated absorbent material.

In an embodiment, the method further includes filling a hair dye reservoir in the barrel.

Further disclosed is a method of dying hair. The method includes providing an absorbent material 116 impregnated with hair dye within a barrel 102 having a hollow center and a hook 118 extending from one end of the barrel, wherein the absorbent material is configured to extend beyond the one end of the barrel. The method includes moving the absorbent material toward the hook to provide a loop to capture hair within the loop.

In an embodiment, the method further includes moving the barrel with the hair captured in the loop along a length of the hair.

In an embodiment, the method further includes that the hair is captured in the loop and the absorbent material impregnated with hair dye is facing toward the interior of the loop.

Figure 7:
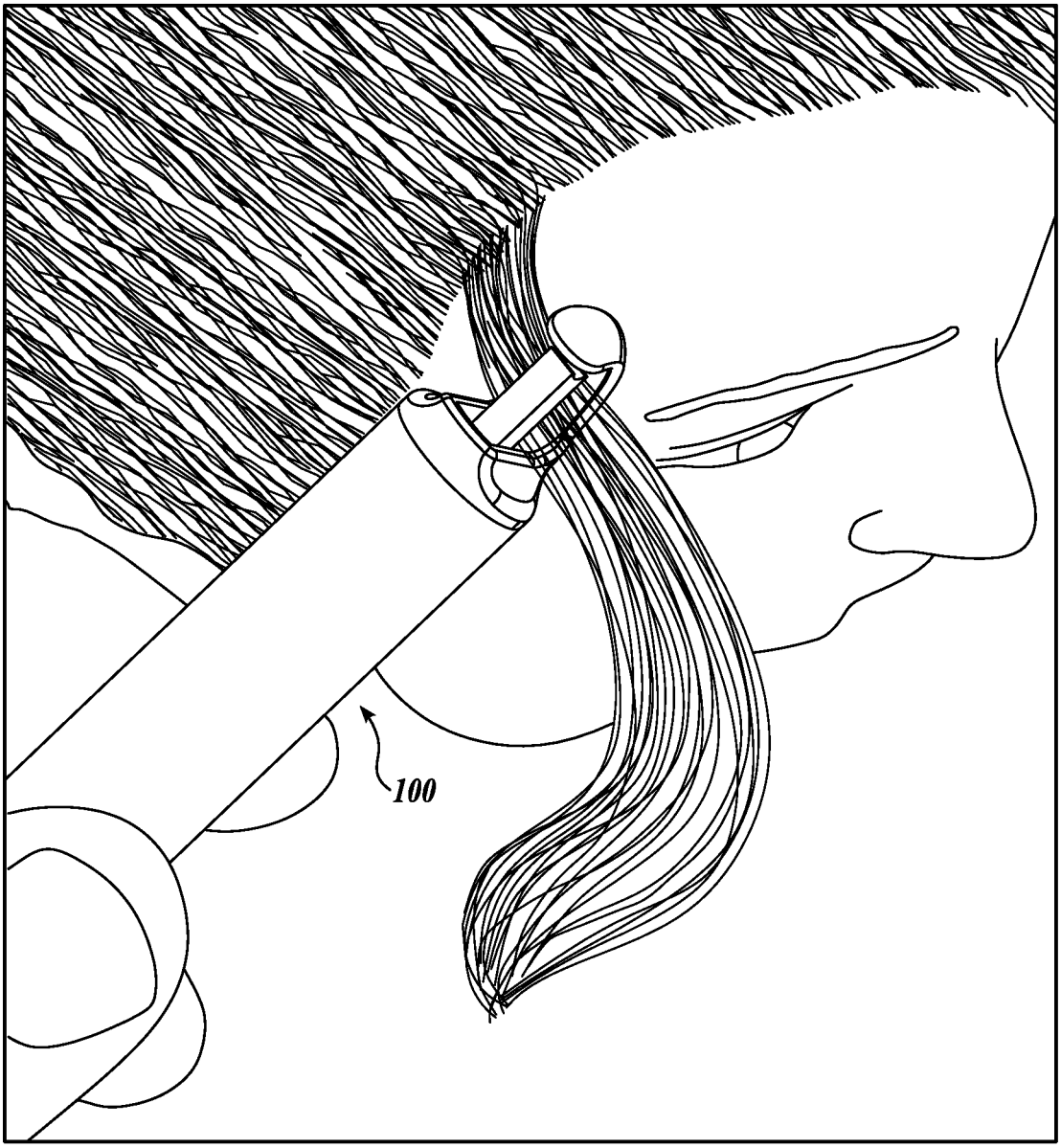
FIG. 7 is a diagrammatical illustration illustrating the use for the hair dye device.

Referring to FIG. 7, a hair dye device 100 or 200 has a barrel 102 with an absorbent material 116 that has been extended from the barrel toward the hook 118 to capture strands of hair within the loop formed from the hook and absorbent material. Once captured in the loop, the barrel can be moved along the length of the hair to dye the hair.

While one representative retracting mechanism 122 with a cam is shown and described, it is to be appreciated that other retracting mechanisms can be substituted for the one shown. For example, one embodiment of a retracting mechanism 122 relies on a twisting motion of two different parts of the barrel. Another embodiment of a retracting mechanism 122 relies on a side lever that is pushed so that a detent holds the absorbent material in the extended position and pushing the lever down will disengage the detent and retract the absorbent material into the barrel. Another embodiment of a retracting mechanism 122 employs an electric-mechanical mechanism. For example, in an embodiment the retractable absorbent material is connected to a solenoid. The solenoid may be powered to either extend out or retract in with the opposite direction being powered by a spring. The solenoid can be operated with DC current or common household current, such as 60 phase, 120 volt AC. In another embodiment, the retracting mechanism 122 is a spring loaded mechanism that will unload the spring to either extend out or retract in the absorbent material, and movement in opposition to the spring is manually operated, such as through a plunger or lever. In another embodiment, the retracting mechanism 122 is hydraulically actuated. A hydraulically actuated retracting mechanism may be implemented with a dual action cylinder where a piston in the cylinder can receive hydraulic fluid on both sides of the piston depending on the positioning of a 4-way valve, for example. The dual action cylinder works by filling a chamber on a side of the piston, while emptying the chamber on the opposite side of the piston. In another embodiment, the retracting mechanism 122 does not lock into place, but can be configured to apply a variable force against the hook. In this embodiment, a spring loaded retractable applicator tip stays within the pen until actuated by the user but doesn't lock in the extended position, so the user is then able to control how much pressure is applied to the hair. The user applies pressure on the plunger to extend the absorbent material tip but there is no locking in position. The user can apply constant pressure or vary the amount of pressure with which the absorbent material contacts the hair or the hook by relaxing or increasing the pressure on the plunger as desired.

While illustrative embodiments have been illustrated and described, it will be appreciated that various changes can be made therein without departing from the spirit and scope of the invention.

The embodiments of the invention in which an exclusive property or privilege is claimed are defined as follows:

1. A hair dye device, comprising:

a barrel, wherein the barrel includes a hollow center and a hook extending from one end of the barrel; and an absorbent material impregnated with hair dye, wherein the absorbent material is configured to extend beyond the one end of the barrel, wherein a tip of an extended absorbent material rests at an apex of the hook to provide a loop to capture hair within the loop, wherein a closed loop is formed when the tip of the absorbent material rests at the apex, wherein a dimension across the absorbent material is less than a dimension across the hook measured at a hook end, and the closed loop includes a space along an inside of the hook between the extended absorbent material and the hook from a start of the hook at the barrel to near the apex of the hook.

2. The hair dye device of claim 1, wherein the absorbent material is configured to retract within the hollow center.

3. The hair dye device of claim 1, wherein the hook is an extension of the barrel.

4. The hair dye device of claim 1, wherein the hook extends from the one end of the barrel and curves from one side of the barrel toward the opposite side, and crosses over the hollow center.

5. The hair dye device of claim 1, wherein the hook extends from the one end of the barrel and curves from one side of the barrel toward the opposite side, and crosses over the barrel center, and the absorbent material extends from the hollow center toward the hook.

6. The hair dye device of claim 1, wherein the hollow center extends in the axial direction.

7. The hair dye device of claim 1, wherein the hook and absorbent material form the loop with a side of the absorbent material impregnated with dye facing the interior of the loop.

8. The hair dye device of claim 1, wherein the hook and absorbent material form a fully closed loop when the absorbent material is touching the hook.

9. The hair dye device of claim 1, wherein the hook and absorbent material form a partly open loop when the absorbent material is not touching the hook.

10. The hair dye device of claim 1, wherein the barrel is on the device exterior, and the absorbent material is on the interior of the barrel.

11. The hair dye device of claim 1, wherein the absorbent material includes fibers, bristles, paper, pulp, animal hairs, felt, or a combination thereof.

12. The hair dye device of claim 1, further comprising a reservoir connected to the absorbent material.

13. A method of making a hair dye device, comprising:

providing a barrel, wherein the barrel includes a hollow center and a hook extending from one end of the barrel;

providing an absorbent material; and assembling the absorbent material in the hollow center of the barrel, wherein the absorbent material is configured to extend beyond the one end of the barrel, wherein a tip of an extended absorbent material rests at an apex of the hook to provide a loop to capture hair within the loop, wherein a closed loop is formed when the tip of the absorbent material rests at the apex, wherein a dimension across the absorbent material is less than a dimension across the hook measured at a hook end, and the closed loop includes a space along an inside of the hook between the extended absorbent material and the hook from a start of the hook at the barrel to near the apex of the hook.

14. The method of claim 13, further comprising impregnating the absorbent material with a hair dye.

15. The method of claim 14, further comprising replacing a depleted absorbent material with a freshly impregnated absorbent material.

16. The method of claim 14, further comprising filling a hair dye reservoir in the barrel.

17. A method of dying hair, comprising:

providing an absorbent material impregnated with hair dye within a barrel having a hollow center and a hook extending from one end of the barrel, wherein the absorbent material is configured to extend beyond the one end of the barrel; and moving the absorbent material to rest a tip of the extended absorbent material at an apex of the hook to provide a loop to capture hair within the loop, wherein a closed loop is formed when the tip of the absorbent material rests at the apex, wherein a dimension across the absorbent material is less than a dimension across the hook measured at a hook end, and the closed loop includes a space along an inside of the hook between the extended absorbent material and the hook from a start of the hook at the barrel to near the apex of the hook.

18. The method of claim 17, further comprising moving the barrel with the hair captured in the loop along a length of the hair.

19. The method of claim 17, wherein the hair is captured in the loop and the absorbent material impregnated with hair dye is facing toward the interior of the loop.

* * * * *